US009895017B1

(12) United States Patent
Berry

(10) Patent No.: US 9,895,017 B1
(45) Date of Patent: Feb. 20, 2018

(54) ORNAMENT SUSPENSION ASSEMBLY

(71) Applicant: James Berry, Springfield, VA (US)

(72) Inventor: James Berry, Springfield, VA (US)

( * ) Notice: Subject to any disclaimer, the term of this patent is extended or adjusted under 35 U.S.C. 154(b) by 0 days.

(21) Appl. No.: 15/352,786

(22) Filed: Nov. 16, 2016

(51) Int. Cl.
*A47G 33/10* (2006.01)

(52) U.S. Cl.
CPC ..... *A47G 33/10* (2013.01)

(58) Field of Classification Search
CPC ..... A47G 33/06; A47G 33/08; A47G 33/10; A47G 33/0809; A47G 1/007; F21S 4/10; A47F 5/04; F21W 2121/04
USPC ..... 362/123, 249.18, 249.19; 428/18, 19, 20
See application file for complete search history.

(56) References Cited

U.S. PATENT DOCUMENTS 2,453,695 A * 11/1948 Belling ..... F21S 4/10 174/44
3,296,430 A 1/1967 Eckert
3,674,612 A * 7/1972 Gehl ..... F21S 4/10 248/27.8
4,076,126 A * 2/1978 Gilmour ..... A47F 5/04 211/125
4,101,697 A * 7/1978 Dieffenbach ..... A47G 33/06 428/20
4,396,652 A * 8/1983 Koehler ..... A41G 1/007 211/105
4,421,801 A 12/1983 Wahlfahrt
4,980,608 A * 12/1990 Morrison ..... A47G 33/0809 315/179
5,071,098 A 12/1991 Aldridge
5,085,901 A * 2/1992 Johnson ..... A47G 33/06 211/196
5,094,893 A * 3/1992 Snider ..... A47G 33/06 211/205
5,104,608 A * 4/1992 Pickering ..... A47G 33/06 362/123
5,280,682 A * 1/1994 Fussell ..... A47F 5/025 362/123
5,523,130 A 6/1996 Sullivan
5,735,415 A 4/1998 Wilson
6,012,590 A 1/2000 Sanchez
6,458,435 B1 * 10/2002 Lai ..... A41G 1/007 362/123
6,668,977 B2 * 12/2003 Arsenault ..... A01M 31/02 108/152
D571,687 S 6/2008 Spencer
7,540,622 B1 * 6/2009 Bechtol ..... F21S 10/02 362/121
8,657,071 B2 * 2/2014 Curry ..... A01M 31/02 182/128
2002/0195529 A1 * 12/2002 Vanech ..... A47G 7/045 248/218.4
2005/0247837 A1 * 11/2005 Spencer ..... A47B 96/061 248/218.4

* cited by examiner

*Primary Examiner* — Patrick Hawn

(57) ABSTRACT

An ornament suspension assembly includes a plurality of hoops and each of the hoops is removably coupled to a Christmas tree. A plurality of rotation units is provided and each of the rotation units is selectively suspended from an associated one of the hoops. A plurality of ornaments is selectively suspended from an associated one of the rotation units thereby facilitating each of the rotation units to rotate the associated ornament.

7 Claims, 4 Drawing Sheets

ORNAMENT SUSPENSION ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to suspension devices and more particularly pertains to a new suspension device for suspending ornaments from a Christmas tree.

BRIEF SUMMARY OF THE INVENTION

An embodiment of the disclosure meets the needs presented above by generally comprising a plurality of hoops and each of the hoops is removably coupled to a Christmas tree. A plurality of rotation units is provided and each of the rotation units is selectively suspended from an associated one of the hoops. A plurality of ornaments is selectively suspended from an associated one of the rotation units thereby facilitating each of the rotation units to rotate the associated ornament.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
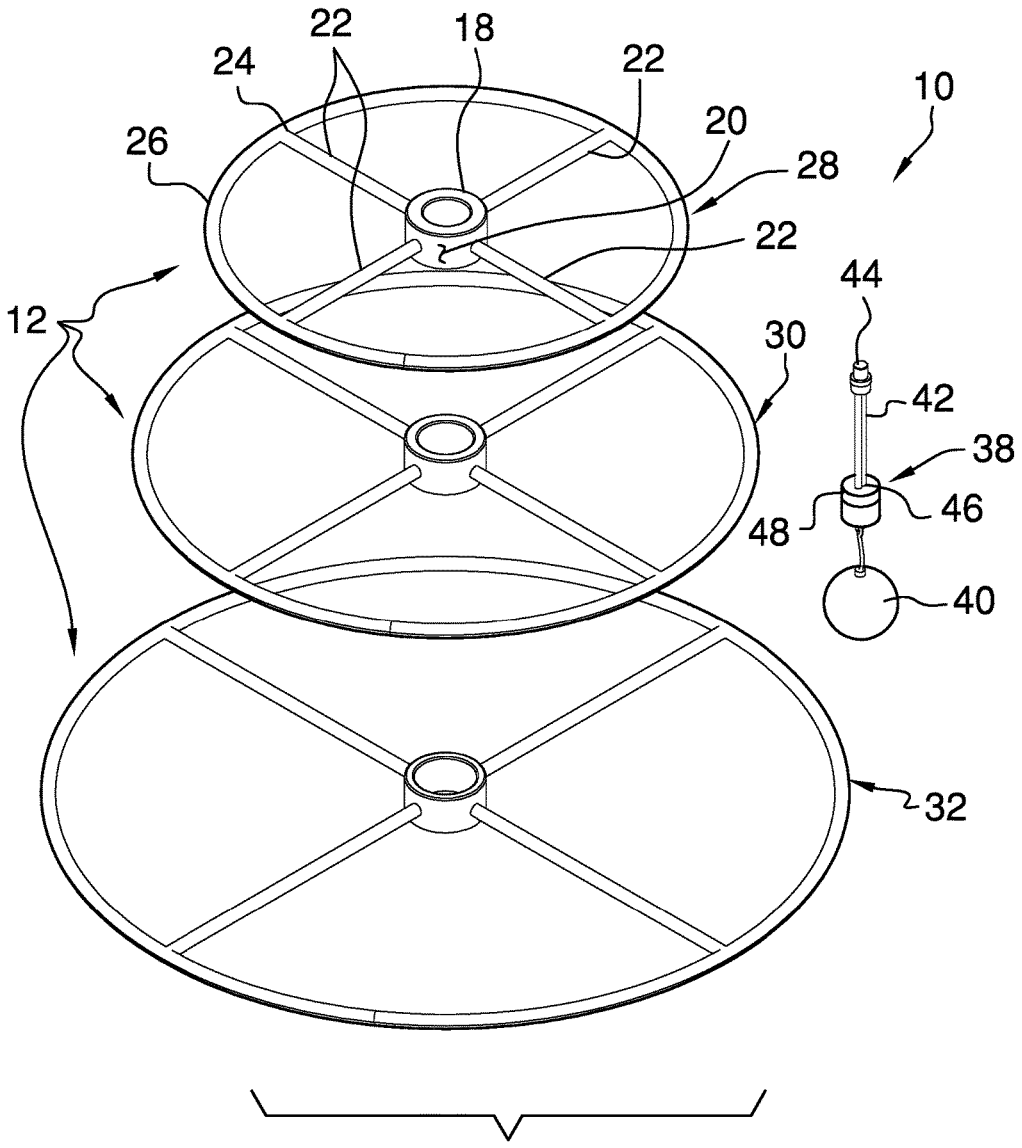
FIG. 1 is a perspective view of an ornament suspension assembly according to an embodiment of the disclosure.
Figure 2:
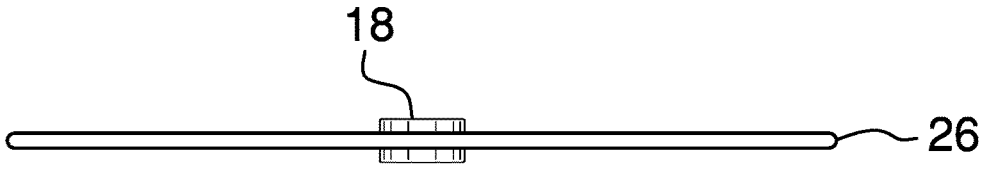
FIG. 2 is a front view of an embodiment of the disclosure.
Figure 3:
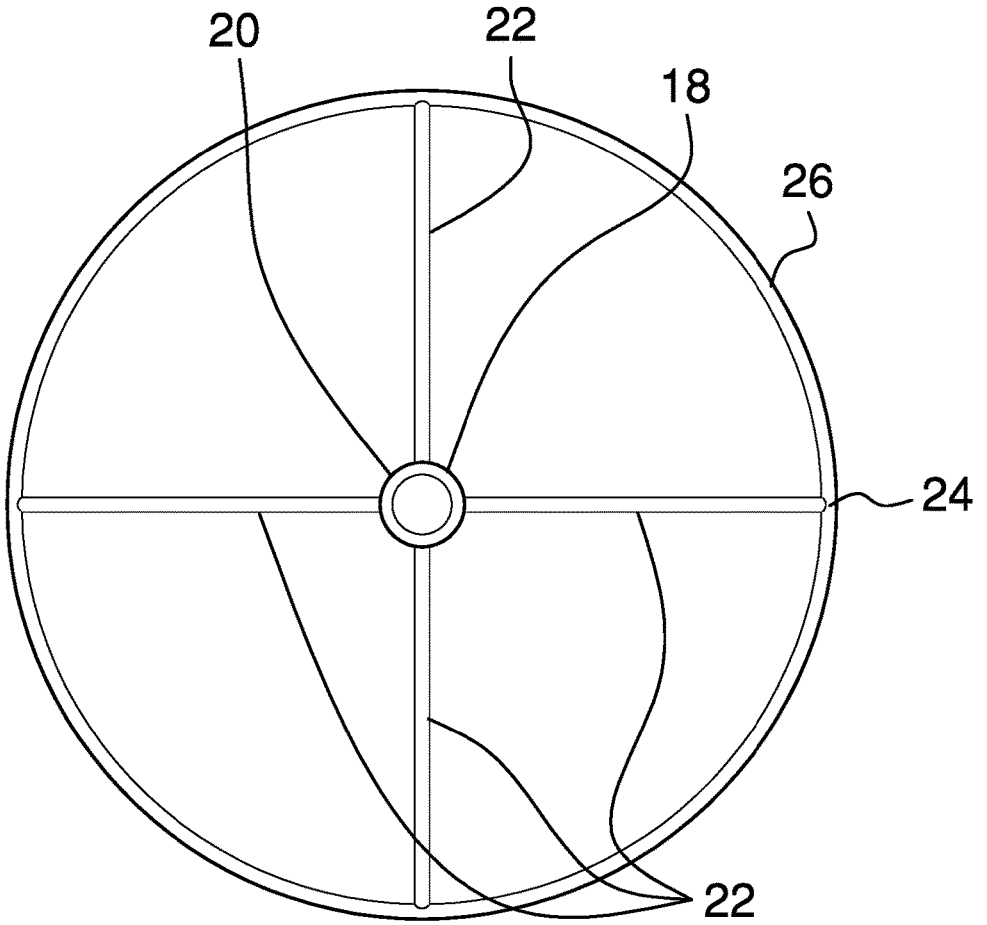
FIG. 3 is a top view of an embodiment of the disclosure.
Figure 4:
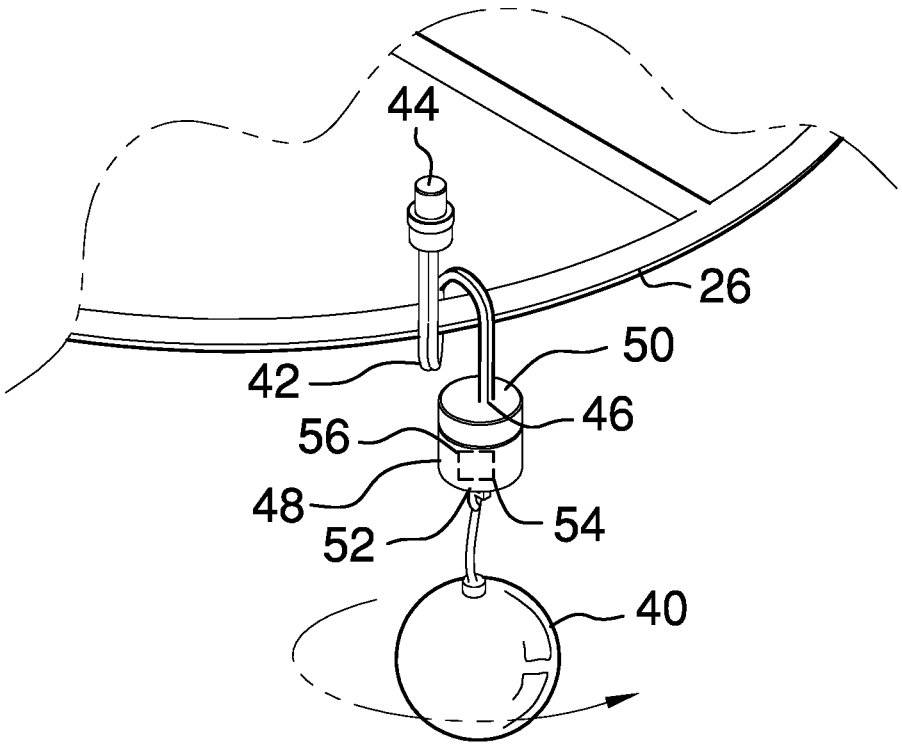
FIG. 4 is a perspective in-use view of an embodiment of the disclosure.
Figure 5:
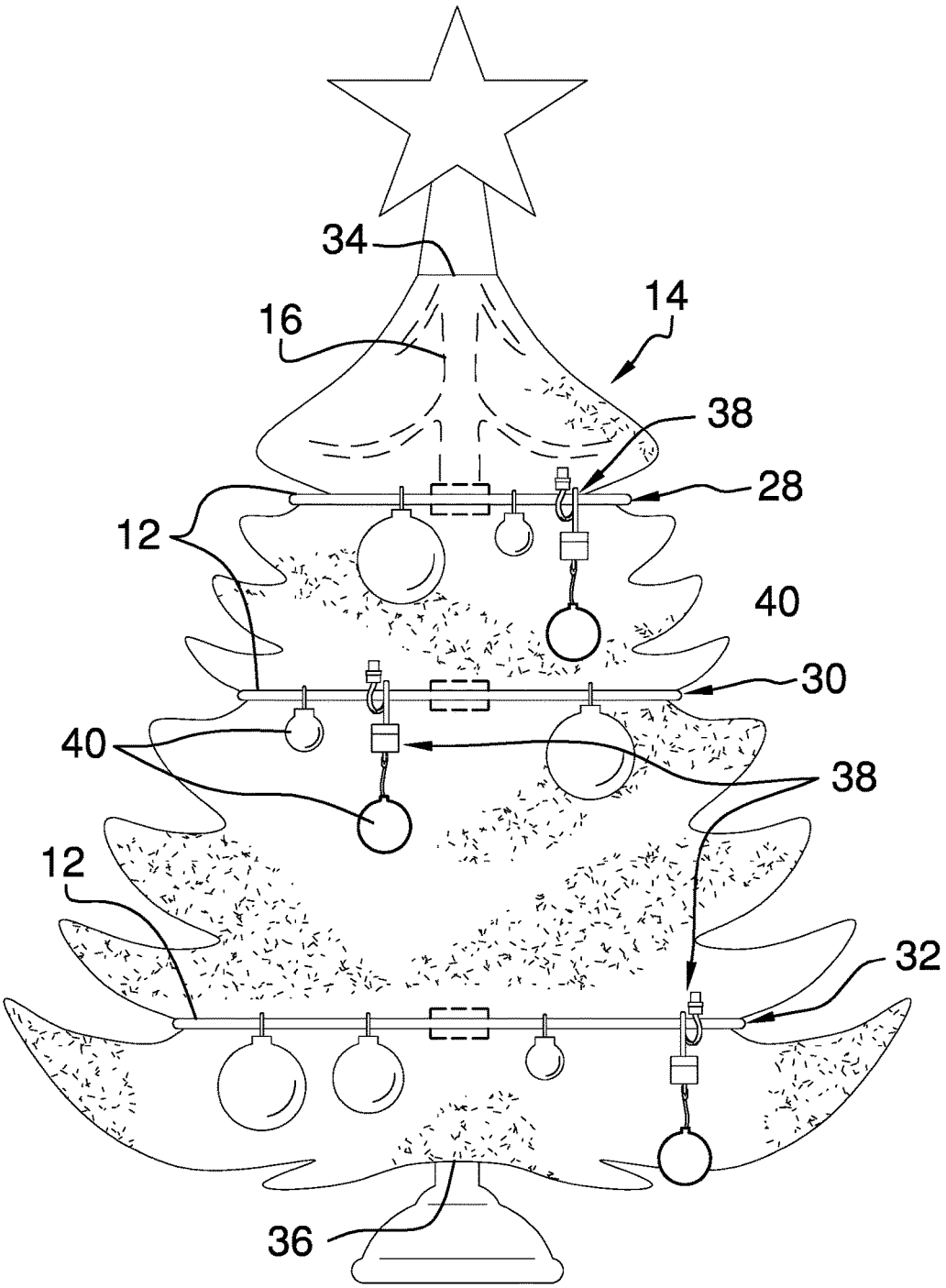
FIG. 5 is a front perspective in-use view of an embodiment of the disclosure.

With reference now to the drawings, and in particular to FIGS. 1 through 5 thereof, a new suspension device embodying the principles and concepts of an embodiment of the disclosure and generally designated by the reference numeral 10 will be described.

As best illustrated in FIGS. 1 through 5, the ornament suspension assembly 10 generally comprises a plurality of hoops 12 that each may be removably coupled to a Christmas tree 14. The Christmas tree 14 may be an artificial Christmas tree 14 or the like. Moreover, a trunk 16 of the Christmas tree 14 includes a plurality of sections.

Each of the hoops 12 comprises a first ring 18 that insertably receives an associated one of the sections of the trunk 16. The first ring 18 has an outer surface 20. A plurality of arms 22 is provided and each of the arms 22 is coupled to and extends outwardly from the outer surface 20 of the first ring 18. The arms 22 are spaced apart from each other and are distributed around the first ring 18. Each of the arms 22 has a distal end 24 with respect to the first ring 18. A second ring 26 is coupled to the distal end 24 corresponding to each of the arms 22 such that the second ring 26 forms a concentric circle with respect to the first ring 18.

The plurality of hoops 12 includes a first hoop 28, a second hoop 30 and a third hoop 32. Each of the arms 22 corresponding to the third hoop 32 has a length that is greater than a length of the arms 22 corresponding to the second hoop 30. Each of the arms 22 corresponding to the second hoop 30 has a length that is greater than a length of the arms 22 corresponding to the first hoop 28.

The second ring 26 corresponding to the third hoop 32 has a diameter that is greater than a diameter of the second ring 26 corresponding to the second hoop 30. Continuing, the second ring 26 corresponding to the second hoop 30 has a diameter that is greater than a diameter of the second ring 26 corresponding to the first hoop 28. The first hoop 28, the second hoop 30 and the third hoop 32 are distributed between a top end 34 of the Christmas tree 14 and a bottom end 36 of the Christmas tree 14. The first hoop 28 is positioned near the top end 34 of the Christmas tree 14, the third hoop 32 is positioned near the bottom end 36 of the Christmas tree 14 and the second hoop 30 is positioned between the first and third hoop 32s 12.

A plurality of rotation units 38 is provided and each of the rotation units 38 is selectively suspended from an associated one of the hoops 12. A selected one of a plurality of ornaments 40 is suspended from each of the rotation units 38 thereby facilitating each of the rotation units 38 to rotate the selected ornament 40. Each of the ornaments 40 may be Christmas ornaments of any conventional design.

Each of the rotation units 38 comprises a member 42 that has a first end 44 and a second end 46. The member 42 is comprised of a resiliently bendable material such that the member 42 is wrapped around the second ring 26 corresponding to a selected one of the hoops 12. In this way each of the rotation units 38 is removably suspended from the associated hoop 12.

Each of the rotation units 38 further includes a motor 48 that has a top end 50 and a bottom end 52. The top end 50 of the motor 48 is coupled to the second end 46 of the member 42 such that the motor 48 is suspended from the selected hoop 12 when the member 42 is wrapped around the second ring 26 of the associated hoop 12. The bottom end 50 of the motor 48 rotates about an axis extending through the top end 50 and the bottom end 36 when the motor 48 is turned on. The selected ornament 40 is suspended the bottom end 52 of the motor 48 thereby facilitating the motor 48 to rotate the selected ornament.

The motor 48 may be an electric motor or the like and each of the rotation units 38 may be an electric ornament rotator. A power supply 54 is provided and the power supply 54 is positioned within the motor 48. The power supply 54 is electrically coupled to the motor 48 and the power supply 54 comprises at least one battery 56.

In use, each of the sections corresponding to the Christmas tree trunk 16 is extended through the first ring 18 corresponding to an associated one of the first 28, second 30 and third 32 hoops. The Christmas tree 14 is assembled such that the first 28, second 30 and third 32 hoops are distributed in decreasing diameter between the top end 34 and the bottom end 36 of the Christmas tree 14. The plurality of rotation units 38 are suspended from the second ring 26 corresponding to each of the first 28, second 30 and third 32 hoops. In this way the rotation units 38 are distributed around the Christmas tree 14. The ornaments 40 are suspended from an associated one of the rotation units 38 and each of the rotation units 38 rotates the associated ornament 40.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An ornament suspension assembly being configured to be attached to a tree, said assembly comprising:

a plurality of hoops, each of said hoops being configured to be removably coupled to the tree, each of said hoops comprises a first ring being configured to have a trunk of the tree extended therethrough, said first ring having an outer surface, each of said hoops including a second ring;

a plurality of rotation units, each of said rotation units being selectively suspended from an associated one of said hoops, each of said rotation units being configured to have an ornament suspended therefrom thereby facilitating each of said rotation units to rotate the associated ornament, each of said rotation units comprises a member having a first end and a second end, said member being comprised of a resiliently bendable material such that said member is wrapped around said second ring corresponding to a selected one of said hoops; and each said rotation unit comprising a motor having a top end and a bottom end, said top end being coupled to said second end of said member such that said motor is suspended from said selected hoop when said member is wrapped around said second ring of said associated hoop, said bottom end rotating about an axis extending through said top end and said bottom end when said motor is turned on, said bottom end being configured to have an associated one of the ornaments suspended therefrom thereby facilitating said motor to rotate the associated ornament.

2. The assembly according to claim 1, further comprising a plurality of arms, each of said arms being coupled to and extending outwardly from said outer surface of said first ring, said arms being spaced apart from each other and being distributed around said first ring, each of said arms having a distal end with respect to said first ring.

3. The assembly according to claim 2, further comprising a second ring being coupled to said distal end corresponding to each of said arms such that said second ring forms a concentric circle with respect to said first ring.

4. The assembly according to claim 2, wherein said plurality of hoops includes a first hoop, a second hoop and a third hoop, each of said arms corresponding to said third hoop having a length being greater than a length of said arms corresponding to said second hoop, each of said arms corresponding to said second hoop having a length being greater than a length of said arms corresponding to said first hoop.

5. The assembly according to claim 4, further comprising:

each said hoop having a second ring; and said second ring corresponding to said third hoop having a diameter being greater than a diameter of said second ring corresponding to said second hoop, said second ring corresponding to said second hoop having a diameter being greater than a diameter of said second ring corresponding to said first hoop, said first hoop, said second hoop and said third hoop being configured to be distributed between a top end of the tree and a bottom end of the tree.

6. The assembly according to claim 1, further comprising a power supply being positioned within said motor, said power supply being electrically coupled to said motor, said power supply comprising at least one battery.

7. An ornament suspension assembly being configured to be attached to a tree, said assembly comprising:

a plurality of hoops, each of said hoops being configured to be removably coupled to the tree, each of said hoops comprising:

a first ring being configured to have a trunk of the tree extended therethrough, said first ring having an outer surface, a plurality of arms, each of said arms being coupled to and extending outwardly from said outer surface of said first ring, said arms being spaced apart from each other and being distributed around said first ring, each of said arms having a distal end with respect to said first ring, and a second ring being coupled to said distal end corresponding to each of said arms such that said second ring forms a concentric circle with respect to said first ring;

said plurality of hoops including a first hoop, a second hoop and a third hoop, each of said arms corresponding to said third hoop having a length being greater than a length of said arms corresponding to said second hoop, each of said arms corresponding to said second hoop having a length being greater than a length of said arms corresponding to said first hoop, said second ring corresponding to said third hoop having a diameter being greater than a diameter of said second ring corresponding to said second hoop, said second ring corresponding to said second hoop having a diameter being greater than a diameter of said second ring corresponding to said first hoop, said first hoop, said second hoop and said third hoop being configured to be distributed between a top end of the tree and a bottom end of the tree; and a plurality of rotation units, each of said rotation units being selectively suspended from an associated one of said hoops, each of said rotation units being configured to have an ornament suspended therefrom thereby facilitating each of said rotation units to rotate the associated ornament, each of said rotation units comprising:

a member having a first end and a second end, said member being comprised of a resiliently bendable material such that said member is wrapped around said second ring corresponding to a selected one of said hoops, a motor having a top end and a bottom end, said top end being coupled to said second end of said member such that said motor is suspended from said selected hoop when said member is wrapped around said second ring of said associated hoop, said bottom end rotating about an axis extending through said top end and said bottom end when said motor is turned on, said bottom end being configured to have an associated one of the ornaments suspended therefrom thereby facilitating said motor to rotated the associated ornament, and a power supply being positioned within said motor, said power supply being electrically coupled to said motor, said power supply comprising at least one battery.

* * * * *